United States Patent [19]

Stoody

[11] Patent Number: 4,852,807

[45] Date of Patent: Aug. 1, 1989

[54] NEOTERIC SIMPLIFIED AEROSOL VALVE

[76] Inventor: William R. Stoody, 8659 Summerdale Rd., San Diego, Calif. 92126

[21] Appl. No.: 173,924

[22] Filed: Mar. 28, 1988

[51] Int. Cl.[4] ..... B05B 1/30

[52] U.S. Cl. ..... 239/337; 220/3; 239/573; 239/576; 239/579; 239/600

[58] Field of Search ..... 239/337, 573, 576, 579, 239/600, 468; 222/402.1, 402.21, 402.22, 402.23, 402.24; 220/3

[56] References Cited

U.S. PATENT DOCUMENTS

| | | | |
|---|---|---|---|
| 2,906,461 | 9/1959 | Bretz, Jr. | 239/337 |
| 2,975,944 | 3/1961 | Michel | 222/402.23 |
| 3,048,307 | 8/1962 | Michel | 239/337 |
| 3,372,844 | 3/1968 | Kitabayashi | 222/402.1 |
| 3,598,324 | 8/1971 | Macguire-Cooper | 222/402.24 |
| 3,613,964 | 10/1971 | Gronemeyer | 222/402.24 |
| 3,620,421 | 11/1971 | Macguire-Cooper | 222/402.21 |
| 4,410,110 | 10/1983 | Del Bon et al. | 222/402.21 |

FOREIGN PATENT DOCUMENTS

| | | | |
|---|---|---|---|
| 1179892 | 2/1970 | United Kingdom | 222/402.1 |

*Primary Examiner*—Andres Kashnikow
*Assistant Examiner*—Michael J. Forman

[57] ABSTRACT

A push-in-place aerosol dispenser valve configured to advantageously utilizes pressure exerted by pressurizing gas, within a pressurized aerosol container, as a force to sealingly secure the valve in place. The valve has a compliant molded plastic primary structure that integrally includes a nozzle that is resilingly responsive to operational manipulation. Defined within the nozzle is a discharge passageway that terminates at an outlet orifice. The passageway is normally blocked by an obstruent that is moveable by manipulation of the nozzle for unblocking the passageway. And, to accommodate push-in-place mounting the primary structure has an inwardly curved bottom, and a sloping annular retaining ledge that underlies the container opening curl. The bottom, ledge and uniformly distribute force exerted against the bottom, by pressurizing gas, form an equilibrium system that prevents the valve from being dislodged from the container.

12 Claims, 6 Drawing Sheets

NEOTERIC SIMPLIFIED AEROSOL VALVE

RELATED PRIOR ART

Related prior art is, Sack Retention and Pressurizing for Aerosol Type Dispensers, U.S. Pat. No. 4,211,344, issued July 8, 1980 to William R. Stoody, Applicant.

Applicant's related prior art pertains to conventional aerosol valve components being housed within the neck of a sack, and utilization of a plastic collar encircling the neck of a sack as a closure for the container. The prior art generally teaches that intensive pressure exerted against the bottom surface of a sack collar disposed in and underlying the dome opening of an aerosol container will hold the collar tightly against the peripheral surfaces of the opening and thereby produce an effective seal against leakage of the container contents at the dome opening and collar interface. However the prior art is more particularly directed toward the retention of a sack within an aerosol container. And, the valve components described therein are of well known construction which is completely different from the valve of the present invention.

BACKGROUND OF THE INVENTION

The present invention pertains to a novel simplified molded plastic dispensing valve that is functionally analogous with the conventional valves having universal application for foam, stream and spray form dispensing. Molded plastic construction of a complete valve is a major breakthrough and departure from heretofore known construction principles for aerosol valves. The only similarities between the present invention valve and conventional valves are: each fits in and closes the opening of an aerosol container; they facilitate discharge of pressurized fluids; and they are manually operable in a like manner.

Unlike the present invention, conventional valves typically comprise: a metal cup having a central opening through which a stem projects; and a separate rubber gasket, or grommet, disposed beneath and sealing the opening. The stem is a separate entity that extends upwardly through the gasket and includes an obstruent flange that is normally biased against the underside of the gasket closing the valve. And for spray form dispensing, a separate dispensing head typically is mounted on the distal end of the stem, and a separate plastic valve body containing a steel spring for biasing the stem flange is nested in the valve cup and clamped in place by a crimped surrounding wall of the valve cup.

The valve of the present invention, in its preferred embodiment, has definite advantages over existing valves in that: it is all plastic; it is more economical to produce; it is compatible with both aluminum and steel containers; it has a single entity valve body having, inclusively molded therewith, a nozzle member and a base structure member that are continuously joined by a springy diaphragm member; and it has an obstruent that is biased against the valve body, and cooperates with the nozzle for opening and closing of the valve against dispensation of fluent material. The diaphragm member facilitates resilingly responsive movement of the nozzle for manual dispensing operation, opening and closing, of the valve.

The heretofore needs for the conventional steel spring, the conventional valve body, the conventional rubber gasket/grommet, the conventional metal cup, have been eliminated. The present invention also provides for an integrally formed outlet orifice for dispensation of fluent material in spray form, thus eliminating the need for a separate conventional dispensing head.

SUMMARY OF THE INVENTION

There is a need for a lower cost aerosol valve having universal application for both aluminum and steel containers. The primary object of the present invention is to satisfy that need by providing an aerosol valve that is a two piece entity, having a valve body and an obstruent.

Another object is to provide an aerosol valve that is constructed exclusively of plastic materials.

Another object is to provide an all plastic aerosol valve that is configured to accommodate simple push-in-place mounting and locking in the dome opening of an aerosol container.

It is another object to provide an all plastic aerosol valve that is constructed so as to advantageously utilize internal pressure force within an aerosol container to make sure sealing closure of the aerosol dispenser.

It is another object to provide an all plastic valve having an integral resilingly moveable nozzle for foam dispensing applications.

It is another object to provide an all plastic valve having an integral resilingly moveable nozzle for spray dispensing applications.

It is another object to provide an all plastic aerosol valve that advantageously utilizes pressure within an aerosol container to make sure sealing closure of an obstruent which constitutes a valving means.

It is another object to provide a simplified all plastic aerosol valve that, in its entirety, consists of a single component.

Still another object is to provide an aerosol valve having a one piece entity plastic valve that includes a nozzle and valving means that are resilingly and cooperatively moveable.

These and other objects will be seen from the following specifications and claims in conjunction with appended drawings.

THE DRAWINGS

Figure 2:
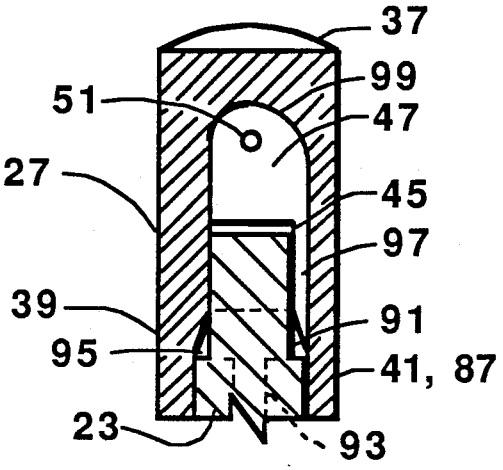
FIG. 2 is a longitudinal cross sectional view of the distal end portion of the valve nozzle, taken in the direction of arrows 2—2 of FIG. 1.
Figure 12:
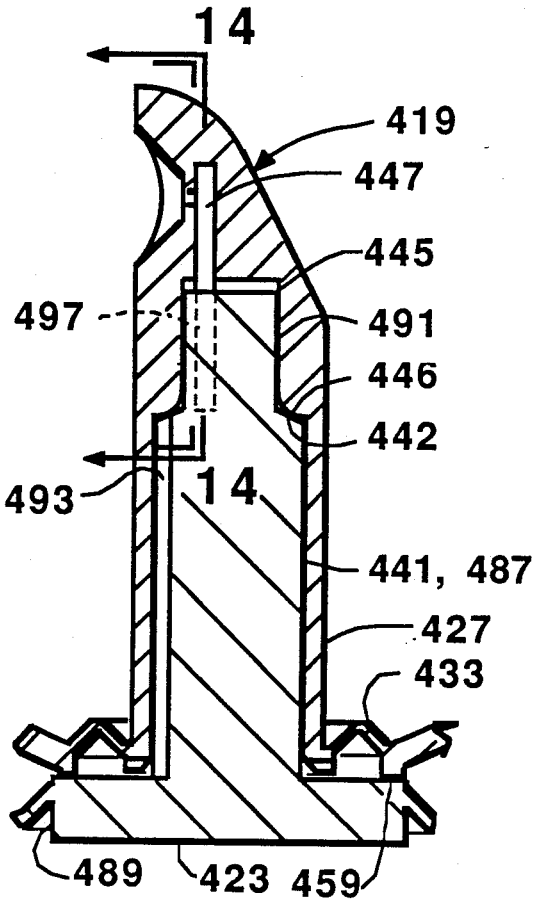
FIGS. 12 and 13 are longitudinal cross sectional fragmentary views, similar to FIGS. 1 and 4 respectively, showing the nozzle portion of a valve having a secondary passageway closure means provided the nozzle.
Figure 13:
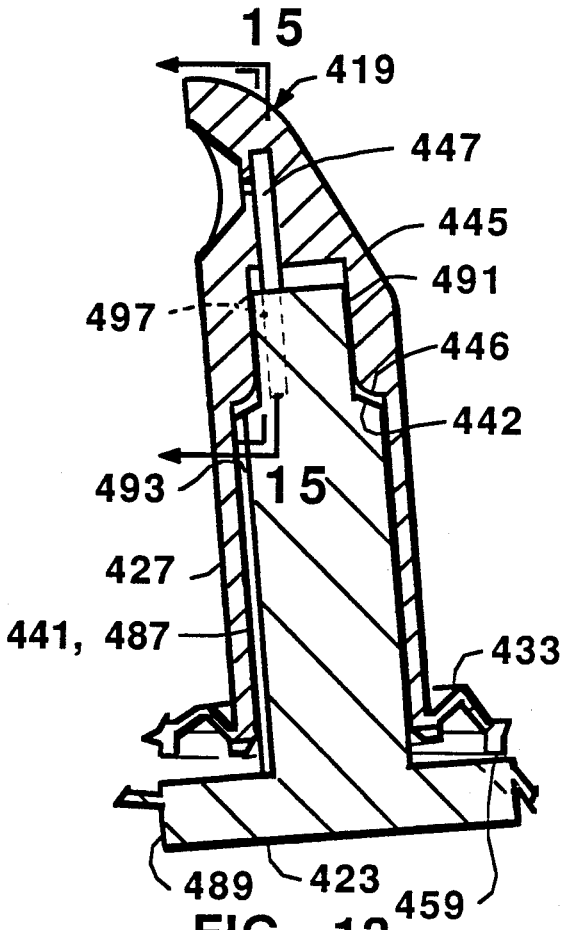
Figure 14:
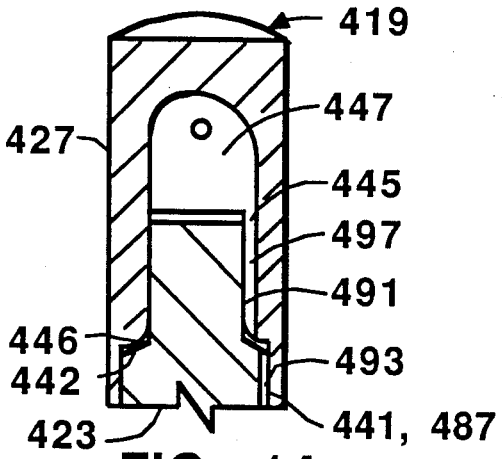
Figure 15:
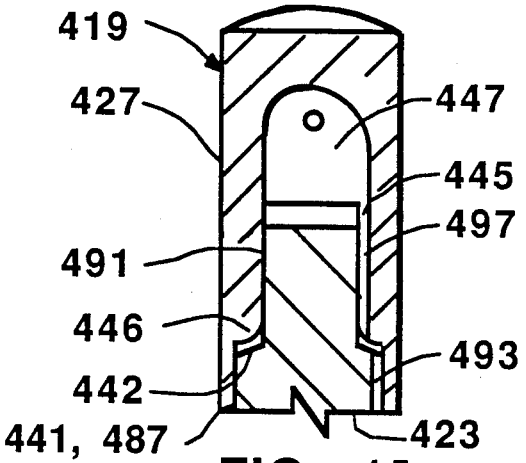

FIGS. 14 and 15 are cross sectional fragmentary views, similar to FIG. 2, taken in the direction of arrows 14—14 and 15—15 of FIGS. 12 and 13 respectively, to further illustrate the passageway closure means.

DETAILED DESCRIPTION OF THE INVENTION

Specific terminology resorted to in describing the illustrative embodiments of the present invention is not intended to be limiting. It is understood that this is for clarity and includes all technical equivalents which function in a similar manner to accomplish a similar purpose or result. Well known variations of prior art aerosol valves are contemplated to be inclusive in the present invention.

Figure 1:
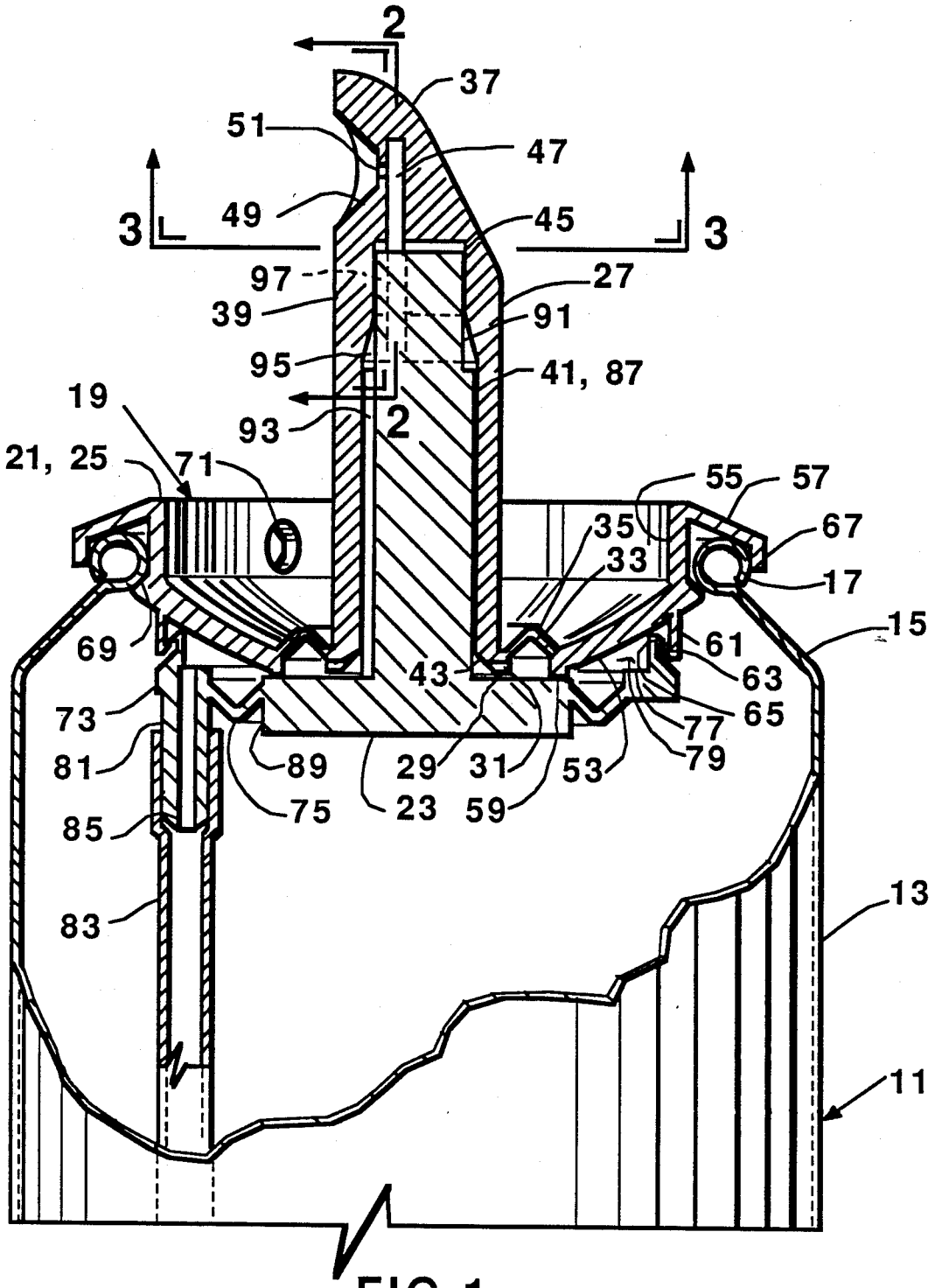
FIG. 1 is a partial exterior view of an aerosol dispenser having the upper portion broken away revealing, in cross section, a compliant two piece aerosol valve disposed in the dome opening of a container.

Referring to the drawing, particularly FIG. 1, shown therein is the upper portion of an aerosol type dispenser 11, or the like, having a conventional container 13 for containment of a fluent material such as a liquid, a foam, or finely divided powdered material to be dispensed, and a quantity of pressurizing gas. The term pressurizing gas is considered to be inclusive of compressed air as produced within a squeeze bottle and any other means for causing fluent material to be driven, under pressure, from its confinements. The container shown herein, broken away for illustrative convenience, has a dome top 15 having a central fill opening that is defined by a raised, smoothly rounded, annular rim 17.

Disposed in and sealingly closing the opening is a neoteric simplified aerosol dispenser valve 19, shown in its preferred embodiment, for controlled dispensing of said fluent material. Said valve is normally in a closed state against dispensation of fluent material and manually operable to an open state for said dispensing. The valve, in its entirety, is made of semiflexible molded plastic or other suitable elastically compliant material. A suitably coated metal having good flexibility, also being an acceptable valve material. Compliancy of the material enables deflection and spring back for placement of the valve into the container opening, sealing closure of the container opening, manual operation of the valve to an open state for dispensing, and biased closure of said valve against dispensation of fluent material.

Valve 19, in its preferred embodiment, consists of two basic one piece molded entities, a valve body 21, and a valving means which is generally referred to as obstruent 23. The valve body has three distinct members that have a common axis. One valve body member is a circular shaped base structure 25 having a curved bottom surface that faces downwardly in said opening. The second valve body member is an upstanding, movable, tubular nozzle 27 that is a manipulatively moveable means for manual operation of said valve. The nozzle has a downwardly facing lowermost end face 29 that projects beneath said base structure, and transversing said end face is at least one channel 31. The third valve body member is a flexible annular diaphragm 33 that is continuous between said base structure and the lowermost end portion of said nozzle and it has an annular flexure 35 spaced between its inner and outer circumferences. Said diaphragm sealingly links said nozzle with said base structure and facilitates operational movement of said nozzle. Obstruent 23, which will be described in detail hereinlater, is underlyingly coupled with said valve body so as to be discreetly biased in sealing engagement against the bottom surface of said base structure.

The nozzle has a closed distal end 37 having an external contour that facilitates manual operation of said valve, and an exterior wall designated 39 surrounding a hollow interior that extends lengthwise along the axis of the nozzle. The hollow interior has a diameter 41 having a beveled mouth 43 at said lowermost end face. The uppermost end of diameter 41 is tapered, transitioning from diameter 41 to a lesser diameter 45 that extends toward said distal end for a relatively short distance. Continuing from diameter 45 is a narrow slot-like swirl chamber 47, which will be further described hereinlater, that is spaced from the axis of the valve. Opposite said swirl chamber is a conoidal cavity 49 in exterior wall 39. Said cavity is concentrically situated around a lateral outlet orifice 51 from said swirl chamber.

The configuration of the base structure, in conjunction with the material compliancy, enables inward resiling deflection of the base structure for push-in-place insertion of the valve into the container opening. The base structure includes a concavo-convex bottom 53, the convex side being said bottom surface and the concave side being the opposite, upward facing, surface. Said bottom continuously joins a relatively thin upright circular wall 55 having a slanted, radially extending, annular brim 57. The wall and the bottom are deflectable and snugly recessed within the container opening.

A discernible annular seating surface 59, against which said obstruent is sealingly seated rendering said closed state of the valve, is defined on said bottom surface adjacent to the outer circumference of diaphragm 33. Spaced outwardly from seating surface 59 is a downward facing bezel 61 having a beveled inwardly projecting annular lip 63 that sealingly and latchingly embraces an opposing peripheral lip 65 of said obstruent.

Brim 57 overlies and engages the container opening rim, and includes a vertically depending perimeter skirt 67 that encircles said rim. Spaced beneath said brim, radially sloping from wall 55, is an annular retaining ledge 69 having a perimeter that borders said bottom surface. In addition wall 55 is provided with at least one aperture 71 that facilitates ingression of pressurizing gas into said container after placement of the valve in the fill opening.

The brim and ledge provide a means for mounting of said valve in the fill opening of the container, retainment of the valve in the fill opening, and sealing closure of the fill opening. In place in said opening, the ledge faces upwardly toward a downwardly facing curvature of said opening rim, and is sealingly seated against said downwardly facing curvature. The proximity of the brim and ledge being such that each is forcefully biased, in opposing directions, against said rim. Said brim constitutes a deflectable spring that is normally loaded so as to draw the ledge upwardly against said rim curvature.

An alternative to said ledge is a conventional rubber or plastic o'ring (not shown) partially recessed into said wall.

Cooperatively, wall 55, brim 57 and ledge 69 are resilingly responsive to a relatively light downwardly exerted force against the brim. Such force is conveyed by wall 55 and displaces the ledge from the rim, provided that the force conveyed to the ledge is not overly opposed by back pressure. The displacement provides a wandering flow path (not shown), between said rim and said retaining ledge, from said aperture to the interior of the container for placement of pressurizing gas into said container. The brim resilingly reinstates sealing of the ledge against the downwardly facing rim curvature upon discontinuance of said force.

The concavo-convex curvature of the base structure bottom is such that said bottom surface and uniformly distributed force exerted thereon, by pressurizing gas, form an equilibrium system. The force distributed against the obstruent and the convex surface coincidentally load said retaining ledge radially and outwardly against the lower curvature portion of said rim and the obstruent against seating surface 59.

Force exerted by pressurizing gas within a pressurized aerosol container is advantageously relied on to make sure sealing and retainment of the valve in the container opening, and sealing closure of the obstruent. The concavo-convex bottom of the base structure, under uniformly distributed force exerted by pressurizing gas, is in compression. Thus, it is instilled with tremendous intrinsical strength against rending or buckling, and the resultant radial load at the retaining ledge prevents the valve from being dislodged from the container.

Now concentrating on obstruent 23, lip 65 thereof is formed around the periphery of a substantially flat ring 73 that is continuously attached to the main body portion of said obstruent by a second flexible annular diaphragm 75 which is analogous to diaphragm 33. Diaphragm 75 holds said obstruent biased against seating surface, and facilitates resilingly responsive movement of said obstruent for opening and closing of said valve.

Inboard of lip 65, said ring has a sunken upper surface 77 that is spaced from the bottom surface of said base structure providing a chamber 79 thereat. Depending from said ring is at least one downwardly projecting nipple 81, and fitted on and depending therefrom is a conventional dip tube 83. Said nipple has a through axial hole 85 that opens into said chamber, and thereinto the hole defines a material entry passage which communicates through said dip tube with the lowermost interior region of container 13. It should be understood that said dip tube is normally omitted for foam dispensing, or when a collapsible sack (not shown) for isolated containment of dispensable fluent material is used with the valve.

The main body portion of obstruent 23 consists of a round stem having a diameter 87, and base flange 89 that is upwardly biased against seating surface 59 of said base structure. Biasing of said flange is established by the planar relationship of the flange with lip 65 and the corresponding planar relationship of the seating surface with lip 63. These relationships are such that diaphragm 75 is deflected and it responsively induces biasing of the flange against the seating surface. The stem is slidingly fitted into diameter 41 of said nozzle, and the distal end portion of the stem is stepped from diameter 87 to a lesser diameter 91 that snugly extends into interior diameter 45 of the nozzle. At least one longitudinal groove 93, starting at the base flange and ending when it reaches the distal end portion, is recessed into diameter 87 of said stem. The groove being recessed into said stem is a matter of choice, a groove recessed into diameter 41 of said nozzle is a viable alternative.

Figure 3:
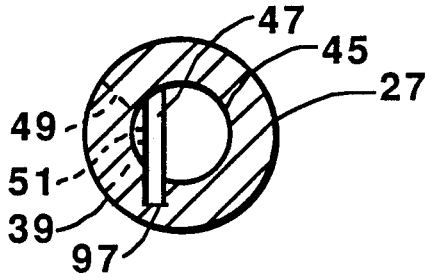
FIG. 3 is a cross sectional view, taken along a horizontal plane in the direction of arrows 3—3 of FIG. 1, at the upper end portion of the valve nozzle.

Stem lengths, from the base flange to the start of diameter 91, and the distal end extending therefrom, are such that they end before bottoming in the hollow interior of the nozzle. In particular, the start of stem diameter 91 is below the start of the hollow interior diameter 45, providing a space 95 around the start of diameter 91. Also, seen in FIGS. 2 and 3, recessed into the side of diameter 45 is a narrow longitudinal continuance 97 from swirl chamber 47, that opens into space 95. Said swirl chamber, as best seen in FIG. 2, has a spiral-like top curvature 99 that tangentially joins said continuance, and induces agitation of pressurized fluent materials entering into the chamber and thereby causes them to break down into small particles before exiting through the outlet orifice. Entrance into said swirl chamber is directed by continuance 97.

Thus it can be appreciated that collectively, outlet orifice 51, swirl chamber 47, continuance 97, space 95, and groove 93 in conjunction with channel 31 and beveled mouth 43 at the lowermost end of the nozzle, define a continuous passageway means from seating surface 59 of said base structure for discharge flow of fluent material from said outlet orifice. Normally entrance into said passageway means from chamber 79 is sealingly blocked by seating of the obstruent base flange against said seating surface, thereby the valve is in a closed state. This closed state is maintained by the obstruent base flange being held biased against said seating surface by diaphragm 75. Additionally, the closed state is made sure by the force exerted against the base flange of said obstruent by pressurizing gas within the container following ingression of said pressurizing gas into said container.

Figure 4:
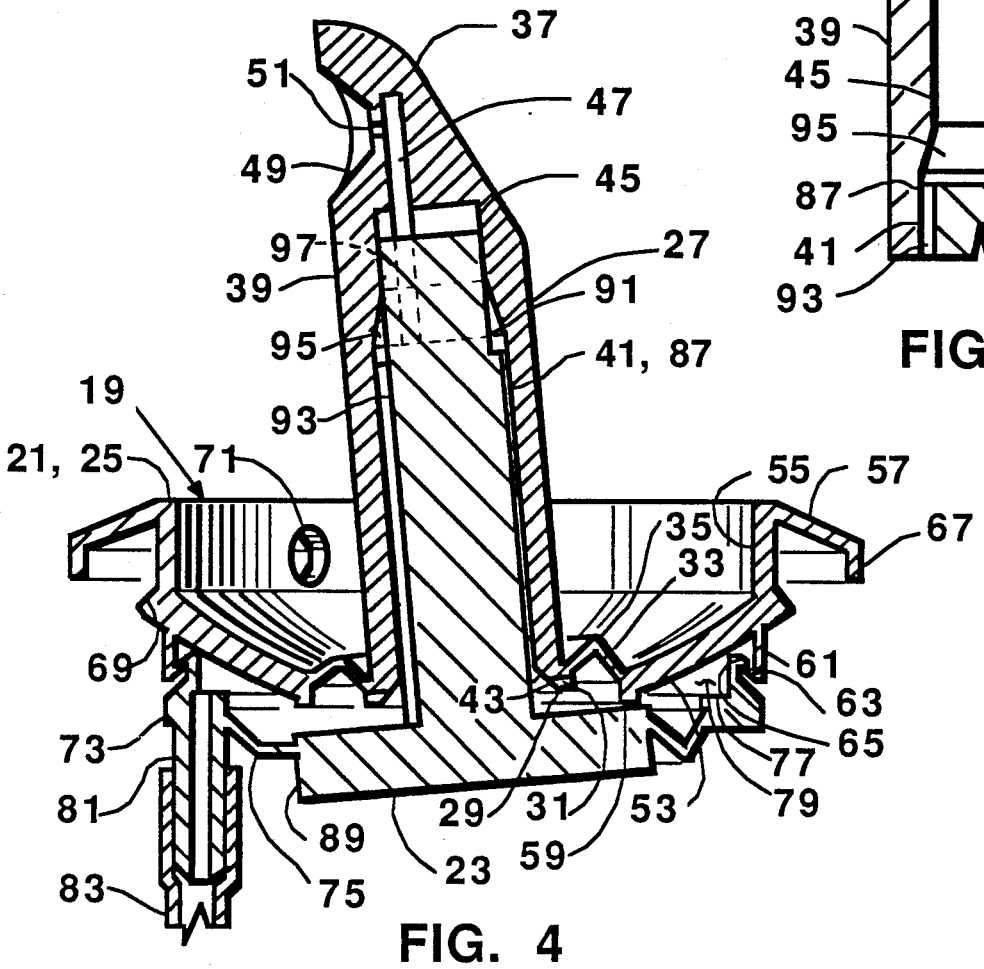
FIG. 4 is a fragmentary cross sectional view, similar to FIG. 1, illustrating said valve in an open state.

It can further be appreciated, as shown in FIG. 4, that unseating displacement of the obstruent base flange unblocks entrance into said passageway means from chamber 79, whereupon said outlet orifice communicates with the interior of said container for dispensation of fluent material therefrom, and thereby the valve is in an open state.

To put the valve in said open state requires manual tilting or depressing operation of the nozzle. This operation is facilitated by diaphragms 33 and 75 which facilitates travel of the obstruent flange, away from the seating surface, corresponding to the movement of the nozzle. The nozzle is resilingly responsive to moveable manipulation, and when released from depression or tilting operation it automatically returns to its normal closed position, thus returning said valve to its normally closed state.

The amount of manual effort needed for valve operation is determined by the length of the nozzle and the resultant resisting force exerted against the seating surface by the obstruent. the length of the nozzle determines the mechanical advantage it provides, and resultant force against obstruent is determined by the gas pressure and the diameter of the obstruent flange. The most optimum results for commonly used gas pressures are provided by a nozzle that is approximately one inch long.

Figure 5:
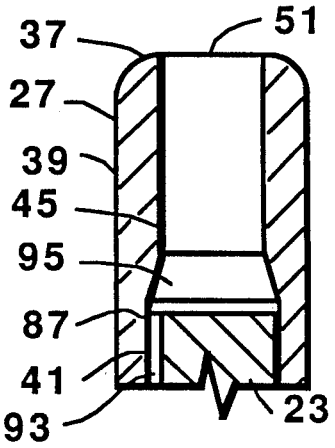
FIG. 5 is a fragmentary cross sectional view illustrating a modified distal end portion of the valve nozzle.

It is thought to be obvious that the valve nozzle readily accommodates the addition of adorning levers, triggers, and such, that provide greater mechanical advantage for operation of said valve. Such adornments are fully contemplated in the present invention. It is also thought to be obvious that a simple modification of the preferred valve embodiment is all that is needed to provide for foam dispensing. In the modification for foam dispensing, as shown in FIG. 5, the swirl chamber and the distal end shaped portions of nozzle 27 are omitted, and diameter 45 extends to the end of the nozzle providing an orifice 51 at the relatively blunt end 37 of said nozzle.

MODIFICATION

Figure 6:
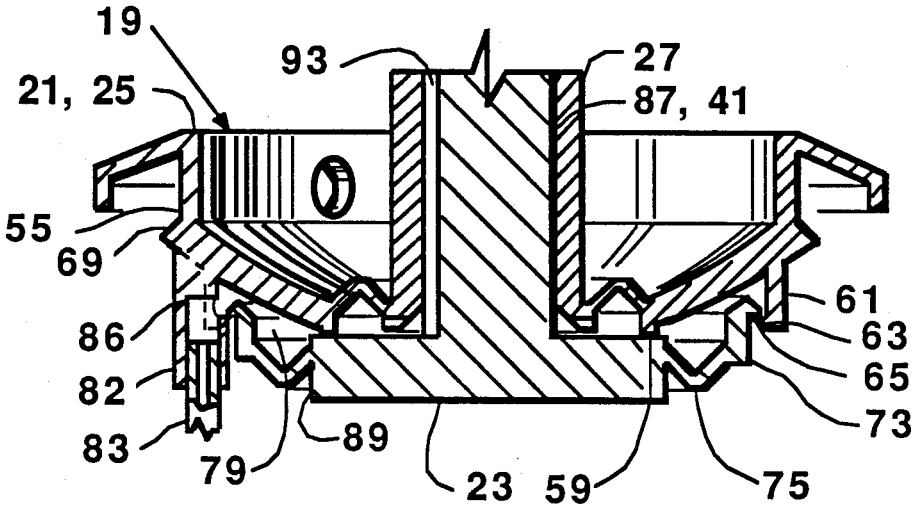
FIG. 6 is a fragmentary longitudinal cross sectional view, of the valve, illustrating an alternative dip tube attachment means.

Shown in FIG. 6 the base structure and obstruent have been modified to illustrate an alternative means for attaching a conventional dip tube 83 to the base structure rather than the obstruent. Here, bezel 61 radially has a protuberant circular boss-like nipple 82 that is tangent on one side with the inner edge of beveled lip 63, and a longitudinal closed bottom hole 86 that tangentially opens into chamber 79 immediately above said lip. Said nipple extends downwardly from said bezel. And dip tube 83 is fitted into said bore, so as to maintain the opening into said chamber, and depends therefrom.

This modification embodiment substitutes nipple 81 and hole 85, of the preferred embodiment, with nipple 82 and hole 86. Annular ring 73 is pictorially altered to accommodate modification of the bezel, and surface 77 has been deleted. All other features and functions of the preferred embodiment are applicable and unchanged in this modified embodiment.

Additional modifications will follow. And in describing the additional modifications, whenever practical, features and entities that are like or similar to those previously described are designated with numbers that respectively have the same last two digits as those numbers used in the description of the preferred embodiment. Generally descriptions of features, functions and entities described in reference to the preferred embodiment will not be repeated in any greater depth than necessary. Odd number designations, i.e., 11, 13, 15, etc., are used in describing the preferred embodiment, so to denote therefrom even number designations are employed in the modifications for describing supplemental features.

MODIFICATION

Figure 7:
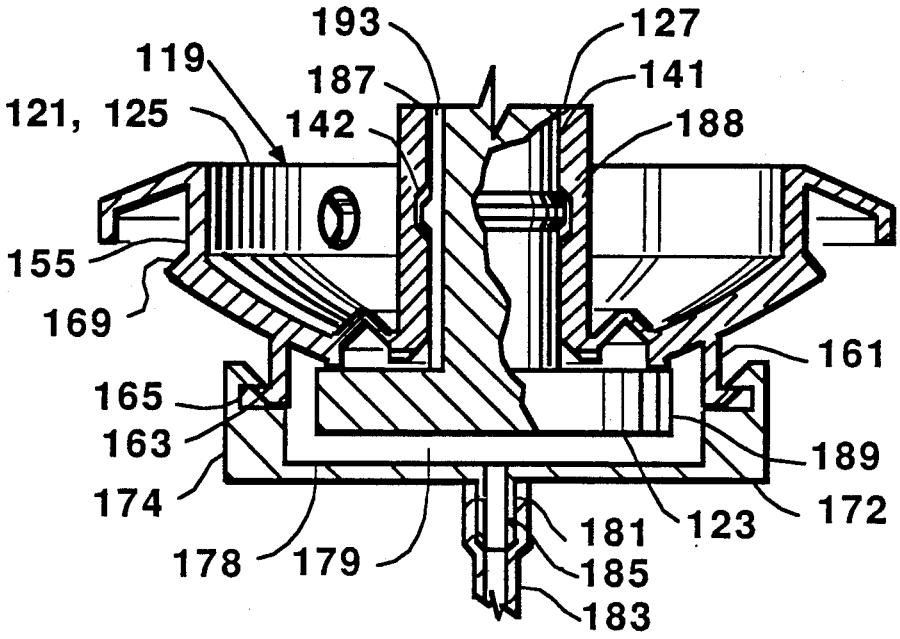
FIG. 7 is a fragmentary longitudinal view, similar to FIG. 6, illustrating a modified valve embodiment having an alternative attachment means for the obstruent, and another alternative dip tube attachment means.

In this modification, shown in FIG. 7, obstruent 123 is retainingly captured in the hollow diameter 141 of nozzle 127 by an annular retaining groove 142 provided therein. For said retainment obstruent stem diameter 187 has a surrounding protuberance 188 that is interrupted at longitudinal groove 193, and engages said retaining groove. The protuberance and retaining groove are provided for attachment of the obstruent to the base structure. This allows ring 73 and diaphragm 75 to be omitted for this valve embodiment.

A separate entity dip tube adaptor 172 depending from base structure bezel 161 is provided for attachment of a conventional dip tube 183. Said adaptor has a cup-like form having a cylindrical upright wall 174 continuously connected to a substantially closed sunken bottom 178. The height of said wall is such that said bottom is spaced beneath obstruent flange 189 providing a chamber 179. At the top of wall 174 is an inboard annular peripheral lip 165 that sealingly and retainingly embraces lip 163 of the bezel. Said adaptor encloses said obstruent within chamber 179. Centrally depending from said bottom is a nipple 181 having a longitudinal hole 185 that opens into said chamber. Fitted on said nipple and depending therefrom is dip tube 183.

MODIFICATION

Figure 8:
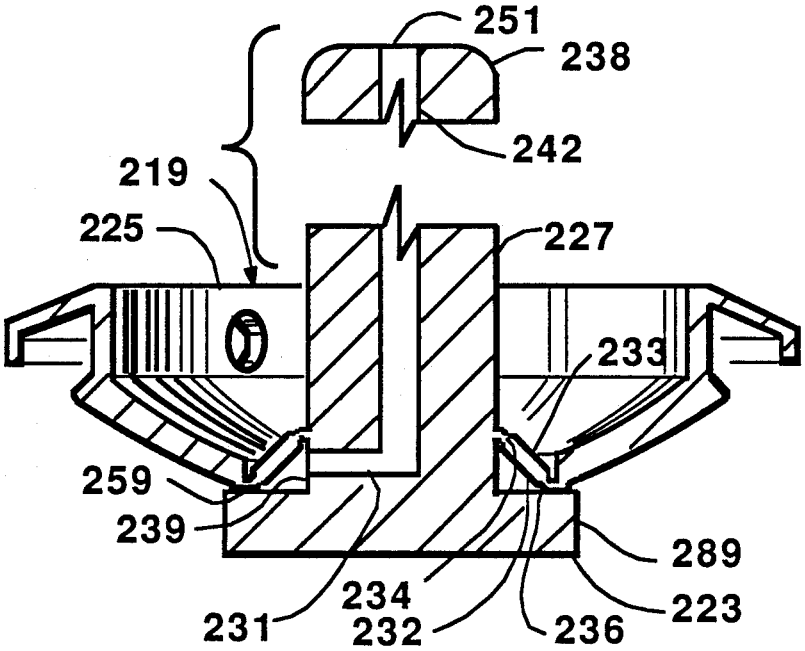
FIG. 8 is a fragmentary longitudinal view, similar to FIG. 7, illustrating a modified embodiment of the valve, whereas, the complete valve is a one piece entity.

Shown in FIG. 8 is an alternative embodiment wherein valve designated 219 in its entirety is a molded one piece entity having: a base structure 225; a nozzle 227 having a lowermost closed end, and a longitudinal bore 242 having an outlet orifice 251 at the distal end 238 of said nozzle; a conically shaped flexible coupling means 233 instead of a diaphragm; and an obstruent flange 289 that is formed at the lowermost end of said nozzle.

Said flange is sealingly seated against a seating surface 259 provided therefor on the bottom of said base structure. A lateral inlet opening 231 into said bore is provided through side wall 239 of said nozzle immediately above said flange. Said inlet opening, bore and outlet orifice define a discharge outlet passageway means for discharge of fluent material from said valve. Operation of the nozzle to open said valve from a closed state unseats the obstruent flange and said passageway means communicates with the interior of said container. Seating of the flange, in the valve closed state, blocks communication of the passageway means with the interior of the container.

Said coupling means has a relatively stiff midwall span 232 and thin pliable innermost and outermost circumferential membranes, 234 and 236 respectively that continuously and sealingly joins said nozzle and said base structure. Said innermost membrane continuously joins said nozzle above opening 231, said outermost membrane continuously joins the base structure.

Figure 9:
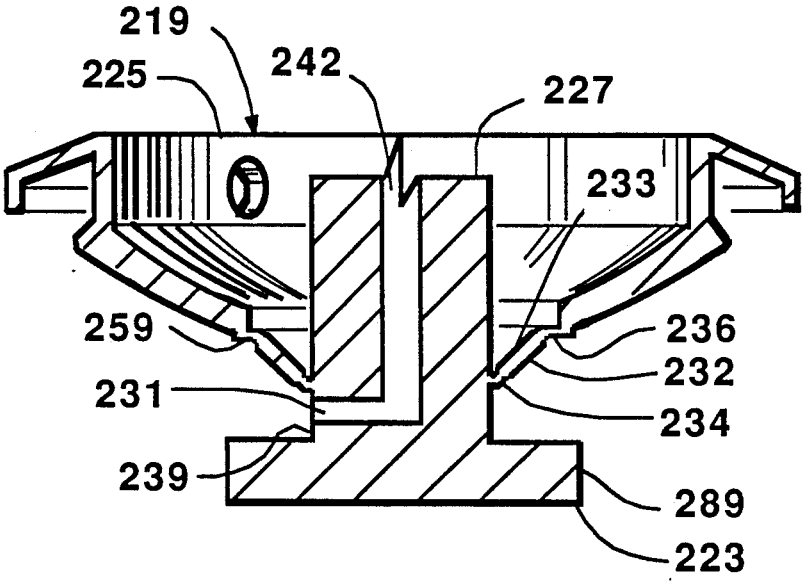
FIG. 9 is a cross sectional view, similar to FIG. 8, showing said one piece entity valve in its as fabricated configuration.

To facilitate molding of the valve as a one piece entity, see FIG. 9, the, as molded, configuration of the conically shaped flexible coupling means has the innermost membrane situated downwardly from the outermost membrane, and the obstruent flange correspondingly spaced downwardly from said base structure. To obtain the operational configuration, shown in FIG. 8, the coupling means is inverted by pushing obstruent upwards toward the seating surface of the base structure. The coupling means resilingly responds to the said pushing in the manner of an overcenter spring.

The base structure and coupling means resistively yield to said pushing until the midwall span is sufficiently raised above the outermost membrane, past the overcenter point the coupling means reactively drives to a fully inverted position, whereby the innermost membrane and obstruent flange are upwardly biased. In an operational condition, force upwardly exerted against the flange by fluent material under pressure, makes the biasing sure.

Features of the preferred embodiment that are excluded from this modification embodiment are: nozzle external cavity 49, closed end 37, swirl chamber 47, curvature 99, continuance 97, space 95, diameter 45, beveled mouth 43, end surface 29; diaphragm 33 and flexure 35; obstruent stem diameters 87 and 91, longitudinal groove 93, diaphragm 75, ring 73, sunken surface 77 and chamber 79, nipple 81 and bore 85 and lip 65; base structure bezel 61 and lip 63; and dip tube 83. Features that have not otherwise been mentioned herein are considered to be inclusive in this modification.

The valve of this modification embodiment is particularly suited for dispensing foam, and fluent material isolated inside of the container from pressurizing gas. It is though to be obvious that for spray form dispensing of fluent material a conventional spray nozzle (not shown) can be readily fitted on the distal end of said nozzle.

MODIFICATION

Figure 10:
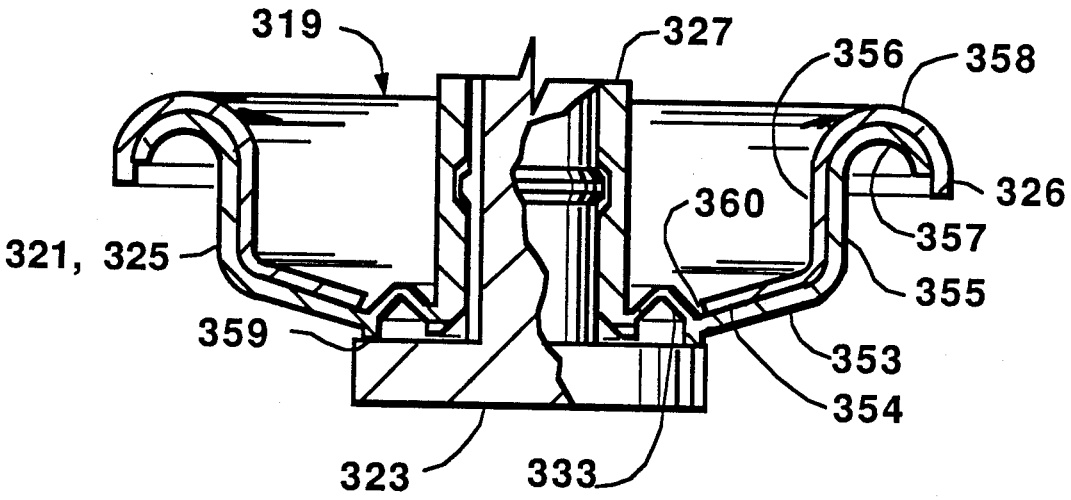
FIG. 10 is a cross sectional, view similar to FIG. 7, showing a modified embodiment of the valve having a mounting cup.

Shown in FIG. 10 is a modified valve 319, similar to hereintofore described valve 119 shown in FIG. 7, having an obstruent 323 and a valve body 321 that includes base structure 325, a diaphragm 333 and a nozzle 327. The most significant difference between valves 119 and 319 is that valve 319 also includes a conventional formed metal mounting cup 326. Another significant difference is that ledge 169 has been eliminated, its function is not needed. In addition, bezel 161, dip tube adaptor 172 and dip tube 183, and their associated features, have been omitted, they are not relevant.

Said mounting cup is shown having a downwardly dished bottom 354 encircled by an upstanding cylindrical wall 356 having a radially extending torus shape brim 358, and an aperture 360 centrally located in the bottom of said cup. The cup is nested in a thin wall base structure 325 which is configured to conform with the shape of said cup. Diaphragm 333 and nozzle 327 freely extend through aperture 360.

Said base structure is a separate molded plastic part having features, a dished bottom 353 that includes an obstruent seating surface 359, an upstanding cylindrical wall 355 having a radially extending annular brim 357, which conform to like names features of said cup. Alternative construction methods, not shown, whereas said base structure is molded integral with said cup, and whereas the cup material and base structure are laminated together prior to shaping of the cup, are anticipated.

Figure 11:
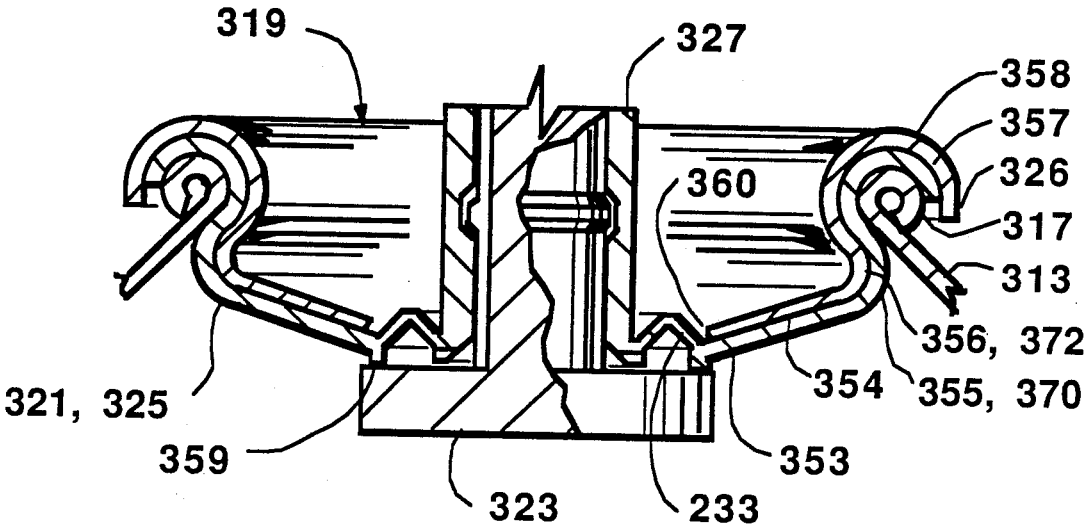
FIG. 11 is a cross sectional view, of the valve and mounting cup shown in FIG. 10, to illustrate mounting of said valve.

In FIG. 11 valve 319 is shown sealingly secured in opening rim 317 of container 313 in the same manner that conventional aerosol valves are secured in containers. Brim 357 of the base structure is between rim 317 of the container and brim 358 of the valve cup. Wall 355 and wall 356, of the base structure and cup, extend into the container opening and said walls are radially deformed so as to provide first and second annular bulges 370 and 372, respectively, that radially extend beneath the rim and thereby secure the valve in said opening. Thus, the base structure is in sealing engagement with said rim and thereby provides a means for sealing closure of the container opening.

MODIFICATION

Fragmentarily depicted in FIGS. 12, 13, 14 and 15 is a modified valve 419 that is provided with a single failure tolerant valving means 423 having an obstruent base flange 489 and an obstruent shoulder 442 constituting a primary obstruction means and a second obstruction means, respectively, for blocking the discharge passageway means provided in nozzle 427. Except for said secondary obstruction means and a secondary seating surface 446 provided therefor, valve 419 is identical to valve 19 hereintofore described, therefore only those features relevant to this modification have been denoted in the FIGS. 12–15.

To facilitate said secondary obstruction means, nozzle 427 hollow transition from diameter 441 to diameter 445 is provided a full radius shoulder, referred to as secondary seating surface 446, instead of a taper. Correspondingly, secondary obstruction means 442 is an inclined shoulder transition, instead of a step, from diameter 487 to the lesser diameter 491 of the valving means stem.

In the valve closed state, said secondary obstruction means is normally biased in annular seating and sealing engagement with said secondary seating surface, as best seen in FIGS. 12 and 13, blocking the outlet end of said discharge passageway means. In the open valve state said secondary obstruction means is spaced from said secondary seating surface, as best seen in FIGS. 13 and 15, unblocking the outlet end of said discharge passageway means.

The radius of said secondary seating surface and the incline of said secondary obstruction means are such that the annular contact line of engagement is midway between diameters 491 and 441. To avoid interruption of said contact line, swirl chamber 447 continuance 497 is recessed into diameter 445 a depth that is less than one-half of said radius, and groove 493 is likewise recessed into diameter 441 a depth that is less than one-half of said radius. In the valve closed state fluid flow communication between groove 493 and continuance 497 is blocked by seating of said secondary obstruction means against said secondary seating surface.

To assure sealing seated engagement of secondary obstruction means 442 with secondary seating surface 446, the vertical distance from said contact line of the engagement to the plane of the valve body seating surface, now referred to as primary seating surface 459, is slightly less than the distance from said contact line of the engagement to the seating plane of primary obstruction means 489. This difference in distance assures that said secondary obstruction means seats before said primary obstruction means seats. Seating of the primary obstruction means is ensured by the compliancy of diaphragm 433, and the force exerted against said primary obstruction means by pressurizing gas within the container following placement of pressurizing gas into said container.

Said exerted force is initially transmitted, via the primary obstruction means and valving means stem, to said secondary obstruction means which in turn imparts the exerted force to the secondary seating surface thereby causing the nozzle to move upwardly until the primary obstruction means is seated. The upward movement of said nozzle is facilitated by deflection of said diaphragm.

Operation of valve 419 to an open state for dispensation of fluent material is accomplished in the manner described in reference to valve 19, except that said open state can only be accomplished by tilting manipulation of said nozzle. With the nozzle in a tilted position, as shown in FIG. 13, said secondary obstruction means is downwardly spaced from said secondary seating surface unblocking the outlet end said discharge passageway means, and said primary obstruction means is sufficiently unseated from said primary seating surface unblocking entrance into said discharge passageway means from beneath said valve body.

To appreciate the relationship of the nozzle and valving means in the open state an understanding of the pivotal movement of the nozzle and valving means is needed. Therefore, it must be understood that nozzle and valving means have different fulcrums. The fulcrum for the nozzle is along the axis of the valve at a point coinciding with the diaphragm and nozzle juncture plane, whereas, the valving means fulcrum is radially offset from the axis of the valve at a point where the primary obstruction means remains in contact with said primary seating surface. Thus, during the tilting operation the valving means stem slides in a downwardly direction, with respect to said nozzle, providing a gap between said secondary obstruction means and said secondary seating surface.

An advantage of the single failure tolerant valving means is valve closing redundancy. Should either the primary or secondary obstruction means fail to seal in the closed state the other, being sealingly seated, sealingly closes the valve.

This modification is also applicable to the valve modification illustrated in FIG. 5 for foam dispensing. And since the secondary obstruction means sealingly closes the outlet end of the discharge passageway means, the potential for hardening or spoilage of fluent material of residue in the nozzle is minimized.

Having described my invention, reference should now be had to the following claims.

I claim:

1. A dispensing valve, for controlled discharge of fluent material confined under pressure in a container having a fill opening having an annular rim, that is normally in a closed state against discharge of said material and being manually operable to an open state for discharge of said material, which comprises:

a flexibly compliant one piece entity valve body having, a base structure member that includes a bottom having a convex underside surface and an annular ledge for attaching said valve to said container opening for closure thereof, an upstanding hollow nozzle member being a moveable means for manipulative operation of said valve to said open state and having a discharge passageway means defined therein and a lowermost end face projecting beneath said base structure member, and a springy diaphragm member continuously joining said base structure member and said nozzle member so as to sealingly and flexibly link said base structure member with said nozzle member;

a one piece entity obstruent, that includes a stem extending into and cooperating with said nozzle, having an annular base flange normally seated and biased in sealing engagement against a discernible seating surface defined on the underside surface of said base structure member;

a ring being sealingly and latchingly embraced in a bezel formed on the bottom surface of said base structure member, and having a depending cylindrical nipple having a through axial hole;

a springy second diaphragm member sealingly and flexibly linking said base flange with said ring, and being continuous with said ring and said flange;

said ring providing a chamber beneath said valve body, and said axial hole being an entry passage into said chamber from the interior region of the container;

said base flange engagement against said seating surface sealingly blocking entrance into said discharge passageway means, whereas, said valve is in said closed state;

said nozzle being resilingly responsive to said moveable manipulation, and said obstruent being moveable in unity with said nozzle for unblocking and blocking said discharge passageway means, whereas, said base flange is displaced from said seating surface by manipulative movement of said nozzle and unblocks entrance into said passageway means, and said base flange is reseated by resilingly responsive movement of said nozzle to said manipulation.

2. In the invention of claim 1, said nozzle having an dispensing head, being integral with said nozzle, that facilitates discharge of fluent material in spray form from said container.

3. In the invention of claim 2, said dispensing head having a swirl chamber;

said swirl chamber being a continuation of said discharge passageway means and having a top curvature for discharge agitation of pressurized fluent materials.

4. In the invention of claim 1, said second diaphragm being deflected and resilingly biasing said base flange against the seating surface of said base structure member.

5. In the invention of claim 1, said nipple having a depending dip tube that facilitates discharge flow of fluent material from the lowermost interior region of the container into said chamber.

6. In the invention of claim 1, said base structure member also includes a an upright circular wall that continuously joins said base structure bottom;

said wall having a radially extending brim, and an annular retaining ledge that is spaced beneath said brim;

whereas, said brim and said retaining ledge provide a means for mounting of said valve in the fill opening of the container, retainment of the valve in the fill opening, and sealing closure of the fill opening;

said brim being a deflectable means for biasing said retaining ledge against the underside of said fill opening rim.

7. In the invention of claim 6, said valve body being adapted to facilitate resilingly responsive movement of said ledge from said rim and having at least one wall aperture that facilitates placement of pressurizing gas into said container.

8. A dispensing valve, for controlled discharge of fluent material under pressure from interior confinements of a container having a fill opening having an annular rim, that is normally in a closed state against discharge of said material and being manually operable to an open state for discharge of said material, which comprises:

a flexible valve body containing a passageway means for discharge of said material, and having a concavo-convex bottom wall encircled by a sloped peripheral ledge having a peripheral diameter that is greater than the diameter of said fill opening for attaching said valve to said container opening for closure thereof;

said valve body being resilingly deflectable for push-in-place insertion of said valve into said fill opening and utilization of pressure within said container for retention of said valve in said container fill opening, whereas, said ledge sealingly engages a downwardly facing curvature of said fill opening rim and said bottom sealingly close said fill opening;

and an obstruent means being underlyingly coupled with said valve body and discreetly biased in sealing engagement against a seating surface provided therefor on the bottom of said valve body to block said passageway means, and being moveable from said engagement to unblock said passageway means.

9. In the invention of claim 8, said valve body having a resilingly moveable, upstanding, hollow nozzle member that facilitates manipulative operation of said valve to said open state.

10. In the invention of claim 9, a springy diaphragm member, being continuous with said valve body and said nozzle member, sealingly and flexibly linking said nozzle member with said valve body.

11. In the invention of claim 9, said obstruent being moveable, from said engagement, corresponding to the movement of said nozzle, facilitating manual operation of said valve to an open state.

12. A dispensing valve that is normally in a closed state and being manually operable to an open state for controlled discharge of fluent material, under pressurizing medium pressure, from interior confinements of a container having a fill opening having an annular rim, which comprises:

a flexible valve body having a bottom wall that facilitates closure of the container opening, and a sloped annular retaining ledge that attaches to said rim and facilitates mounting of said valve in said container opening, whereas, said ledge is biased against a downwardly facing curvature of said rim;

a manipulatively moveable nozzle extending from said valve body for placing said valve in said open state;

said nozzle being resilingly responsive to manipulative movement for closure of said valve, and containing a discharge passageway means for discharge of fluent material from said container;

and an obstruent means, being underlyingly coupled with said valve body and discreetly biased in sealing engagement against a seating surface provided therefor on the bottom of said valve body, blocking entrance of said fluent material into said discharge passageway means;

said obstruent means being moveable from said engagement, corresponding to movement of said nozzle to facilitate discharge of said fluent material;

said bottom and ledge being adapted to utilize force distributed against said obstruent and said bottom by pressurizing medium for sealing and retainment of said valve in said container opening, whereas, said force distributed against said obstruent and said valve coincidentally load said ledge radially and outwardly against said rim curvature, and whereas said bottom is in compression and the resultant radial load exerted by the ledge against the rim prevents said valve from being dislodged from said container.

* * * * *